United States Patent [19]

Seeman

[11] Patent Number: 4,649,822

[45] Date of Patent: Mar. 17, 1987

[54] METHOD AND APPARATUS FOR DEACTIVATING A PARTIALLY FLOODED PERFORATING GUN ASSEMBLY

[75] Inventor: Bronislaw Seeman, Missouri City, Tex.

[73] Assignee: Schlumberger Technology Corporation, Houston, Tex.

[21] Appl. No.: 728,056

[22] Filed: Apr. 29, 1985

[51] Int. Cl.[4] ..... F42C 1/02

[52] U.S. Cl. ..... 102/275.1; 102/275.7; 89/1.15; 175/4.6

[58] Field of Search ..... 89/1.14, 1.15; 102/275.1, 275.5, 275.7; 175/4.6

[56] References Cited

U.S. PATENT DOCUMENTS

| | | | |
|---|---|---|---|
| 2,821,136 | 1/1958 | Castel | 89/1.15 |
| 2,994,269 | 8/1961 | Schlumberger | 102/20 |
| 3,189,094 | 6/1965 | Hyde | 89/1.15 |
| 3,346,056 | 10/1967 | Bohn | 175/4.6 |
| 3,860,865 | 1/1975 | Stroud | 89/1.15 |
| 4,314,614 | 2/1982 | McPhee et al. | 174/4.56 |

*Primary Examiner*—Harold D. Whitehead

[57] ABSTRACT

A method and apparatus for deactivating a partially flooded perforating gun assembly utilizes a fuse which extends downwardly to the lower end of a perforating gun section and is then associated with an explosive coupler having a means for interrupting the transmission of an explosive force upon the presence of undesired fluid in the lower end of the gun section.

12 Claims, 3 Drawing Figures

METHOD AND APPARATUS FOR DEACTIVATING A PARTIALLY FLOODED PERFORATING GUN ASSEMBLY

FIELD OF THE INVENTION

The invention relates to a method and apparatus for deactivating a partially flooded perforating gun assembly which is used in the completion of oil and gas wells to perforate the well casing.

DESCRIPTION OF THE PRIOR ART

It has become common practice in the completion of oil and gas wells to perforate the well casing to bring the well into production by the detonating of explosives of high velocity and of the general character and form known as "shaped charges". In the operation of a shaped charge perforator gun assembly, a tubular gun assembly containing a plurality of charges is lowered into the wellbore. The gun is positioned opposite the subsurface formation to be perforated. Upon detonation, the shaped charges form a hot stream of high pressure gases and high velocity particles, which perforate the well casing and subsurface formation.

A major safety concern when utilizing such gun assemblies is that undesired fluid from the wellbore may enter the gun assembly prior to detonation of the shaped charges. A gun assembly may be substantially completely filled, or flooded, with undesired fluid, or it may be partially filled, or flooded, with the undesired fluid from the wellbore. If a gun assembly is either partially or fully flooded, detonation of the shaped charges within the gun assembly will typically rupture with great force the tubular gun assembly housing. This rupturing not only destroys the gun assembly, but it can also in turn rupture and damage the wellbore casing. There are no methods or apparatus presently available for deactivating the detonation of a partially flooded perforating gun assembly which is activated from the top of the gun assembly.

Perforating gun assemblies are generally of two types: wireline conveyed gun assemblies; and tubing conveyed gun assemblies. The shaped charges within a wireline conveyed gun assembly are typically detonated beginning with the lowermost shaped charge, and the detonation path proceeds upwardly through the length of the perforating gun assembly. Such wireline conveyed gun assemblies may utilize fluid desensitized detonators whereby, upon fluid entering the lowermost section of the perforating gun assembly, the entire perforating gun assembly will not be detonated if undesired fluid enters the interior of the lowermost section of the perforating gun assembly. Tubing conveyed perforating gun assemblies typically have the shaped charges detonated beginning with the uppermost shaped charge within the gun assembly, and the detonation path proceeds downwardly along the length of the perforating gun assembly. An advantage of using tubing conveyed perforating gun assemblies is that because the detonator and firing mechanisms are disposed above the perforating gun assembly sections containing the shaped charges, the perforating gun assembly gun sections may all be disposed below the drilling, or working, rig floor before the detonator and firing mechanisms are attached and made operable.

Accordingly, prior to the development of the present invention, there has been neither a method or apparatus for deactivating a partially flooded perforating gun assembly, wherein the gun assembly is activated from the top of the gun assembly, which prevents rupturing of the perforating gun assembly and the well casing, should undesired fluid enter the perforating gun assembly prior to detonation of the shaped charges therein. Therefore, the art has sought a method and apparatus for deactivating a partially flooded perforating gun assembly, wherein the gun assembly is activated from the top of the gun assembly, which prevents rupturing of the perforating gun assembly and the well casing should undesired fluid enter the perforating gun assembly prior to detonation of the shaped charges therein.

SUMMARY OF THE INVENTION

In accordance with the invention, the foregoing advantage has been achieved through the present apparatus for deactivating a partially flooded perforating gun assembly containing a plurality of shaped charges, wherein the gun assembly includes at least an upper and lower gun section, each gun section having upper and lower ends, and the gun assembly is activated from the top of the gun assembly. The present invention includes: a first fuse extending downwardly from the top of the gun assembly to the lower end of the upper gun section; a second fuse extending upwardly from the lower end of the upper gun section, the second fuse being operatively associated with some of the shaped charges; a third fuse extending downwardly from the lower end of the upper gun section to the upper end of the lower gun section; and an explosive coupler associated with the first, second and third fuses; the explosive coupler including means for interrupting the transmission of an explosive force from the first fuse to the second fuse upon the presence of undesired fluid in the lower end of the upper gun section, whereby detonation of the shaped charges within the upper gun section is prevented. A feature of the present invention is that the first fuse may be a contained detonating fuse having a lower explosive content than the second fuse; and the second and third fuses are primacord.

A further feature of the present invention is that the explosive coupler may include means for securing the first, second, and third fuses in an explosive force transmitting relationship; and the means for interrupting the transmission of an explosive force from the first fuse to the second fuse may comprise at least one fluid port formed in the explosive coupler and disposed between the first and second fuses whereby, upon undesired fluid entering the fluid port, an explosive force, sufficient to detonate the second fuse, is not transmitted from detonation of the first fuse. An additional feature of the present invention is that the explosive coupler may be provided with a means for interrupting the transmission of an explosive force from the first fuse to the third fuse, upon the presence of undesired fluid in the lower end of the upper gun section.

The present invention also includes a method for deactivating a partially flooded perforating gun assembly containing a plurality of shaped charges, wherein the gun assembly includes at least an upper and lower gun section, each gun section having upper and lower ends, the gun assembly is activated from the top of the gun assembly. The method of the present invention may include the steps of: lowering the perforating gun assembly and a deactivating apparatus into a well casing, said deactivating apparatus comprising: a first fuse downwardly extending from the top of the gun assembly to the lower end of the upper gun section; a second fuse extending upwardly from the lower end of the upper gun section, and the second fuse operatively associated with some of the shaped charges; a third fuse extending downwardly from the lower end of the upper gun section to the upper end of the lower gun section; and the first, second, and third fuses being associated with one another by an explosive coupler; detonating said first fuse at its upper end; and, upon the presence of undesired fluid in the lower end of the upper gun section, interrupting the transmission of an explosive force from the first fuse to the second fuse, whereby detonation of the shaped charges within the upper gun section is prevented. As an additional feature of the present invention, said first fuse may comprise a contained detonating fuse, the contained detonating fuse having a lower explosive content than the second fuse; as the second and third fuses may comprise primacord.

As a further feature of the present invention, the first, second and third fuses may be secured in an explosive force transmitting relationship; and said interrupting step may be carried out by means of at least one fluid port in the explosive coupler, the at least one fluid port disposed between the first and second fuses, for interrupting the transmission of an explosive force from the first fuse to the second fuse whereby, upon undesired fluid entering the at least one fluid port, an explosive force, sufficient to detonate the second fuse, is not transmitted from detonation of the first fuse.

An additional feature of the present invention may include the step of interrupting the transmission of an explosive force from the first fuse to the third fuse, upon the presence of undesired fluid in the lower end of the upper gun section.

The method and apparatus for deactivating a partially flooded perforating gun assembly of the present invention, when compared with previously proposed deactivation methods and apparatus, has the advantages of being able to be utilized with a gun assembly which is activated from the top of the gun assembly, and prevents rupturing of the perforating gun assembly and the well casing, should undesired fluid enter the perforating gun assembly prior to detonation of the shaped charges therein.

While the invention will be described in connection with the preferred embodiment, it will be understood that the invention is not limited to that embodiment. On the contrary, it is intended to cover all alternatives, modifications and equivalents as may be included within the spirit and scope of the invention as defined by the appended claims.

DETAILED DESCRIPTION OF THE DRAWINGS

Figure 1:
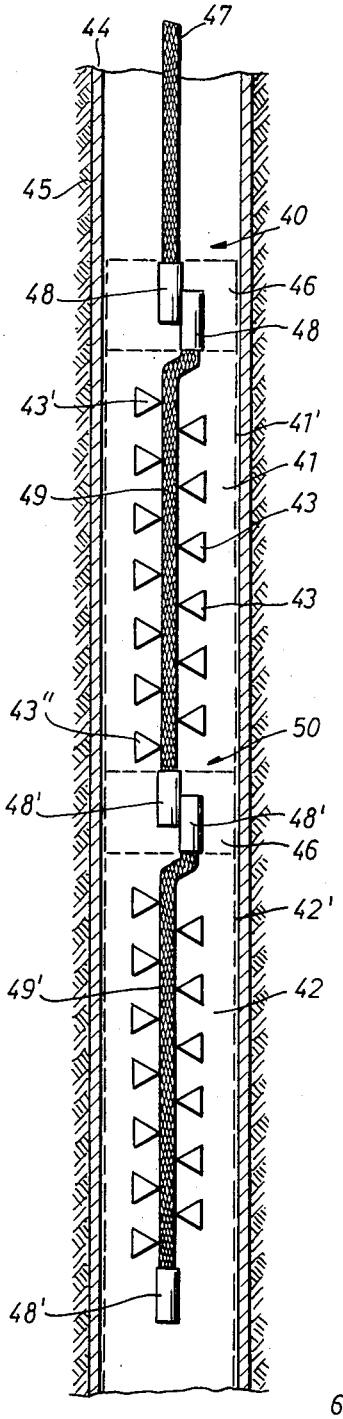
FIG.1 (PRIOR ART)
FIG. 1 is a partial cross-sectional view of a prior art perforating gun assembly disposed within a wellbore.

With reference to FIG. 1, a perforating gun assembly 40 in accordance with the prior art is shown to generally include at least an upper and lower gun section 41, 42, and each gun section 41, 42 of gun assembly 40 contains a plurality of shaped charges 43. For drawing clarity, the conventional tubular housings 41',42' forming each gun section 41, 42 are shown in dotted lines. Perforating gun assembly 40, which is of the tubing conveyed type and detonated from the top of the gun assembly 40 is shown disposed within a conventional well casing 44 in a wellbore 45. As is conventional, an adapter 46 (shown in dotted lines for drawing clarity) or tubular housing, is disposed between the upper and lower gun sections 41, 42. Perforating gun assembly 40 may include as many gun sections 41,42, with spacers 46 therebetween, as are desired to form the desired length of gun assembly, or gun string, 40, as is conventional in the art. A conventional detonator (not shown), is disposed above gun assembly 40 and is attached in a conventional manner to a detonating fuse, or detonating cord 47 which passes downwardly to gun assembly 40. Detonating cord 47 is typically primacord. Detonating cord 47 passes downwardly to an adapter 46, wherein a conventional pair of explosive boosters 48 are disposed side by side. Upon activation of the detonator (not shown), which may be either an electrical or percussion type detonator, a detonation wave travels downwardly from the detonator through detonating cord 47 to boosters 48. The detonation wave then travels downwardly through a detonating cord or fuse 49, which in turn detonates the shaped charges 43, beginning with the topmost shaped charge 43' and ending with the lowermost shaped charge 43''. The detonation wave then travels downwardly to the next set of boosters 48' and to the detonating cord 49' disposed within the lower gun section 42, to in turn detonate the shaped charges 43 disposed within lower gun section 42. This process continues throughout the entire length of the gun assembly, or gun string, 40. As is conventional in the art, detonating cords, or fuses, 49,49' are typically primacord.

As previously described, undesired fluid from the wellbore 45 could enter the lower end 50 of upper gun section 41, and partially flood the interior of a portion of upper gun section 41. Such partial flooding could submerge one or more of the shaped charges 43 therein. Upon the detonating wave travelling downwardly to the submerged shaped charge, or charges, 43, the resulting explosion would typically rupture the upper gun section housing 41', and could likewise damage the wellbore casing 44.

Figure 2:
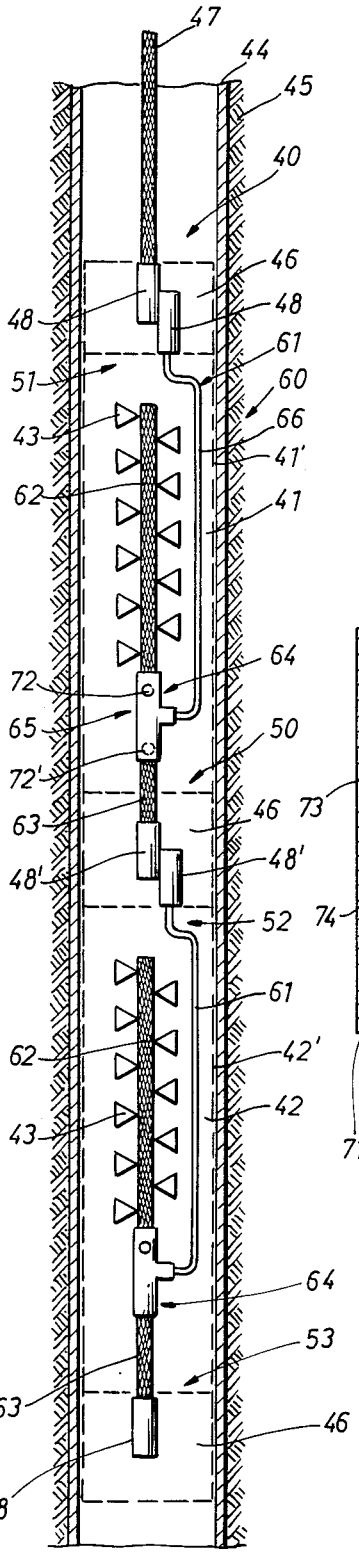
FIG. 2 is a partial cross-sectional view of a perforating gun assembly equipped with the deactivation apparatus in accordance with the present invention.
Figure 3:
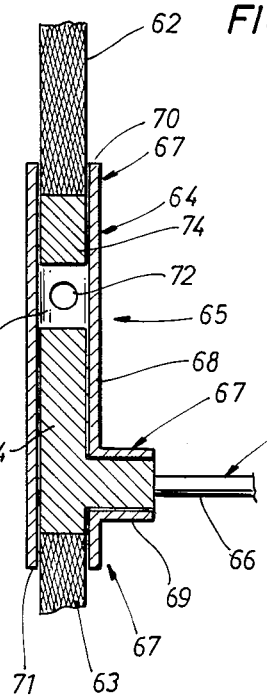
FIG. 3 is a partial cross-sectional view of an explosive coupler in accordance with the present invention.

With reference now to FIGS. 2 and 3, the method and apparatus of the present invention for deactivating a partially flooded perforating gun assembly will be described. The same reference numerals will be utilized in FIGS. 2 and 3 for the same components previously described in connection with FIG. 1. The perforating gun assembly 40 illustrated in FIG. 2 likewise includes at least an upper and lower gun section 41, 42, with a conventional adapter 46 disposed between gun sections 41, 42, with adapter 46 disposed at the upper end 51 of gun section 41. A conventional detonator (not shown) is disposed above perforating gun assembly 40 and has a conventional detonating cord, or fuse, 47 extending downwardly to a pair of side by side explosive boosters 48 disposed within adapter 46. In another embodiment of the present invention, explosive boosters 48 may be disposed end to end. A plurality of conventional shaped charges 43 are likewise disposed within upper and lower gun sections 41 and 42.

Still with reference to FIG. 2, the apparatus 60 of the present invention for deactivating a partially flooded perforating gun assembly 40 generally includes: a first fuse 61 extending downwardly from the top 51 of the gun assembly 40 toward the lower end 50 of the upper gun section 41; a second fuse 62 extending upwardly from the lower end 50 of the upper gun section 41, the second fuse 62 being operatively associated with the shaped charges 43 disposed within the upper gun section 41; a third fuse 63 extending downwardly from the lower end 50 of the upper gun section 41 to the upper end 52 of the lower gun section 42; and an explosive coupler 64 associated with the first, second, and third fuses 61–63. The explosive coupler 64 includes means for interrupting 65 the transmission of an explosive force from the first fuse 61 to the second fuse 62 upon the presence of undesired fluid in the lower end 50 of the upper gun section 41, whereby detonation of the shaped charges 43 within the upper gun section 41 is prevented.

With reference to FIGS. 2 and 3, the first fuse 61 is preferably a contained detonating fuse 66 having a lower explosive content than the second fuse 62. The explosive content of a fuse is typically defined by the number of grains of explosive per linear foot of the fuse, and is thus a well-known term in the art. The first fuse 61, or contained detonating fuse 66, is preferably a commercially available fuse of low explosive contant, which includes a reinforced sheath 67 about the fuse. The detonation of the contained detonating fuse 66 does not damage other explosive components, such as shaped charges 43, within the perforating gun assembly 40. The second and third fuses 62,63 may preferably be conventional primacord fuses having a higher explosive content than the contained detonating fuse 66, whereby the detonation of the second fuse 62 is sufficient to detonate the shaped charges 43. The detonation of the third fuse 63 is sufficient to detonate the conventional explosive boosters 48' disposed within spacer sub 46, disposed between the upper and lower gun sections 41, 42.

Still with reference to FIGS. 2 and 3, the explosive coupler 64 includes means for securing 67 the first, second, and third fuses 61–63 in an explosive force transmitting relationship. Preferably, explosive coupler comprises a tubular housing 68 with a tubular flange 69 disposed thereon for reception of the contained detonating fuse 66. Accordingly, the first, second and third fuses 61–63 may be secured in an explosive force transmitting relationship, as by crimping the ends 70, 71 of tubular housing 68 respectively about second and third fuses 62 and 63, and by crimping tubular flange 69 about confined detonating fuse 66. It should be readily understood by one of ordinary skill in the art that the configuration of explosive coupler 64 could have any other configuration, such as a square or triangular cross-sectional configuration. Further, to allow for an abutting, explosive force transmitting relationship between the first and third fuses 61, 63 fuses 61,63 could be taped, glued, or in any other manner disposed in an abutting explosive force transmitting relationship. Preferably, the means for interrupting 65 transmission of an explosive force from the first fuse 61 to the second fuse 62 may comprise at least one fluid port 72 formed in the explosive coupler 64, or housing 68, which port 72 is disposed between the first and second fuses, 61, 62 and communicates with an air gap 73 within housing 68 between fuses 61–63.

Accordingly, upon undesired fluid entering the upper gun section 41, such fluid would collect in the lower end 50 of upper gun section 41. Should the undesired fluid rise within upper gun section 41 to fluid port 72, such fluid would enter explosive coupler 64, or housing 68, and would be disposed between the first and second fuses 61, 62. Upon detonation of the first fuse 61, a detonating wave, sufficient to detonate the second fuse 62, would not be able to pass through the fluid which has entered explosive coupler 64 through port 72, and the detonating wave would not be transmitted to the second fuse 62. Accordingly, none of the shaped charges 43 disposed within the upper gun section 43 would be detonated, and thus damage to the upper gun section 41 and wellbore casing 44 would be prevented. Insofar as the first and third fuses 61,63 are in an explosive force transmitting relationship, as shown in FIG. 3, the detonating wave would be able to pass downwardly through detonating fuse 63 to the explosive boosters 48' within the adapter 46, disposed between upper and lower gun sections 41, 42, which boosters 48' would in turn detonate the first fuse 61 contained within lower gun section 42. In this regard, lower gun section 42, and any other additional perforating gun sections of perforating gun assembly 40 which would be disposed below gun section 42 may be likewise provided with the apparatus 60 of the present invention for deactivating a partially flooded perforating gun assembly. Thus, as seen in FIG. 2, lower gun section 42 is also provided with first, second, and third fuses 61–63, and explosive coupler 64, as previously described. Accordingly, if no undesired fluid has entered the at least one fluid port 72 of explosive coupler 64 disposed in the lower end 53 of lower gun section 42, the shaped charges 43 of lower gun section 42 would be detonated in the usual manner.

If desired, as shown in dotted lines in FIG. 2, explosive coupler 64 may be provided with a means for interrupting the transmission of an explosive force from the first fuse 61 to the third fuse 63, which interrupter means may comprise another at least one fluid port 72' formed in explosive coupler 64, which communicates with another air gap (not shown) in housing 68 disposed between fuses 61,63. Accordingly, if undesired fluid enters both fluid ports 72, 72', the transmission of an explosive force from the first fuse 61 to both the second and third fuses 62 and 63 will be prevented. It should be noted that, if the air gaps 73 associated with housing 68 do not have any undesired fluid contained therein, the detonation of the fuse 61 is sufficient to transmit a detonating wave, or explosive force, across the gap 73, to detonate fuses 62 or 63.

Explosive coupler 64, as shown in FIG. 3, may also include an explosive material 74 disposed between at least two of the first, second or third fuses, 61–63 and the explosive material 74 may have a higher explosive content than the second and third fuses 62,63, which are preferably primacord. As shown in FIG. 3, explosive material 74 may be disposed between first and third fuses 61,63, or below fluid port 72, or explosive material 74 may also be disposed between the third and second fuses as by disposing it above fluid port 72 in an abutting relationship with second fuse 62. Preferably, explosive material 74 may be a commercially available explosive material known as HNS explosive, which explosive material serves to assist in the transmission of an explosive force, or detonating wave, between the various fuses 61 ∝ 63, and across air gaps 73.

It is to be understood that the invention is not limited to the exact details of construction, operation, exact materials, or embodiment shown and described, as obvious modifications and equivalents will be apparent to one skilled in the art; for example, the interrupter means between the fuses could be a piece of material which transmits an explosive force when it is dry, but will not transmit an explosive force should it become wetted. Accordingly, the invention is therefore to be limited only by the scope of the appended claims.

I claim:

1. An apparatus for deactivating a partially flooded perforating gun assembly containing a plurality of shaped charges, wherein the gun assembly includes at least an upper and lower gun section, each gun section having upper and lower ends, and the gun assembly is activated from the top of the gun assembly, comprising:

a first fuse extending downwardly from the top of the gun assembly to the lower end of the upper gun section;

a second fuse extending upwardly from the lower end of the upper gun section, the second fuse being operatively associated with some of the shaped charges;

a third fuse extending downwardly from the lower end of the upper gun section to the upper end of the lower gun section; and an explosive coupler associated with the first, second, and third fuses; the explosive coupler including means for interrupting the transmission of an explosive force from the first fuse to the second fuse upon the presence of undesired fluid in the lower end of the upper gun section, whereby detonation of the shaped charges within the upper gun section is prevented.

2. The apparatus of claim 1, wherein the first fuse is a contained detonating fuse having a lower explosive content than the second fuse; and the second and third fuses are primacord.

3. The apparatus of claim 1, wherein the explosive coupler include means for securing the first, second, and third fuses in an explosive force transmitting relationship; and the means for interrupting the transmission of an explosive force from the first fuse to the second fuse comprises at least one fluid port formed in the explosive coupler and disposed between the first and second fuses whereby, upon undesired fluid entering the fluid port, an explosive force, sufficient to detonate the second fuse, is not transmitted from detonation of the first fuse.

4. The apparatus of claim 3, further including a means for interrupting the transmission of an explosive force from the first fuse to the third fuse, upon the presence of undesired fluid in the lower end of the upper gun section.

5. The apparatus of claim 4, wherein the means for interrupting the transmission of an explosive force from the first fuse to the third fuse comprises a fluid port formed in the explosive coupler and disposed between the first and third fuses.

6. The apparatus of claim 3, wherein the explosive coupler includes an explosive material disposed between at least two of the first, second, or third fuses, the explosive material having a higher explosive content than the second or third fuse.

7. A method for deactivating a partially flooded perforating gun assembly containing a plurality of shaped charges, wherein the gun assembly includes at least an upper and lower gun section, each gun section having upper and lower ends, and the gun assembly is activated from the top of the gun assembly, comprising the steps of:

lowering the perforating gun assembly and a deactivating apparatus into a well casing, said deactivating apparatus comprising:

a first fuse extending downwardly from the top of the gun assembly to the lower end of the upper gun section; a second fuse extending upwardly from the lower end of the upper gun section, and the second fuse operatively associated with some of the shaped charges; a third fuse extending downwardly from the lower end of the upper gun section to the upper end of the lower gun section; the first, second, and third fuses being associated with one another by an explosive coupler;

detonating said first fuse at its upper end; and upon the presence of undesired fluid in the lower end of the upper gun section, interrupting the transmission of an explosive force from the first fuse to the second fuse, whereby detonation of the shaped charges within the upper gun section is prevented.

8. The method of claim 7, wherein:

said first fuse comprises a contained detonating fuse, the contained detonating fuse having a lower explosive content than the second fuse; and said second and third fuses comprise primacord.

9. The method of claim 7, wherein: 'said first, second, and third fuses are secured in an explosive force transmitting relationship; and said interrupting step is carried out by means of at least one fluid port in the explosive coupler, the at least one fluid port disposed between the first and second fuses for interrupting the transmission of an explosive force from the first fuse to the second fuse whereby, upon undesired fluid entering the at least one fluid port, an explosive force, sufficient to detonate the second fuse, is not transmitted from detonation of the first fuse.

10. The method of claim 7, including the step of interrupting the transmission of an explosive force from the first fuse to the third fuse, upon the presence of undesired fluid in the lower end of the upper gun section.

11. The method of claim 10, wherein the step of interrupting transmission from the first to third fuses is carried out by means of a fluid port in the explosive coupler between the first and third fuses for interrupting the transmission of an explosive force from the first fuse to the third fuse, upon the presence of undesired fluid in the lower end of the upper gun section.

12. The method of claim 9, including the step of intensifying the force transmission within said explosive coupler with an explosive material in the explosive coupler between at least two of the first, second, or third fuses, the explosive material having a higher explosive content than the second or third fuses.

* * * * *